United States Patent [19]

Ishida et al.

[11] Patent Number: 4,468,660

[45] Date of Patent: Aug. 28, 1984

[54] ELECTRIC LIGHT DISPLAY APPARATUS OF LIGHT BLOCKING TYPE

[75] Inventors: Shinya Ishida, Kashihara; Masayoshi Miyata, Hirakata, both of Japan

[73] Assignees: Kinki Nippon Tetsudo Kabushiki Kaisha; Kinki Sharyo Kabushiki Kaisha, both of Osaka, Japan

[21] Appl. No.: 330,250

[22] Filed: Dec. 14, 1981

[30] Foreign Application Priority Data

Dec. 24, 1980 [JP] Japan ..... 55-184890

[51] Int. Cl.[3] ..... G09F 9/00

[52] U.S. Cl. ..... 340/764; 340/815.27

[58] Field of Search ..... 340/815.27, 815.29, 340/764, 783; 40/451, 466

[56] References Cited

U.S. PATENT DOCUMENTS 1,612,504 12/1926 Furman ..... 340/815.29 X 2,141,473 12/1938 Hubertz ..... 340/815.27

4,161,832 7/1979 Bergamini ..... 340/764 X

*Primary Examiner*—David L. Trafton

*Attorney, Agent, or Firm*—Holman & Stern

[57] ABSTRACT

An electric light display apparatus of the light blocking type comprising slender discharge tubes arranged in parallel rows on the front side of the apparatus and each divided by openable light blocking members into a multiplicity of sections arranged continuously longitudinally of the tube. The sections are exposed or shielded by the blocking members individually to display the desired characters, illustrations or like images with a collection of bright portions and dark portions. The apparatus is simple in construction and less susceptible to malfunctions and displays images of high luminance which are distinctly perceivable visually without requiring a great power consumption.

11 Claims, 14 Drawing Figures

ELECTRIC LIGHT DISPLAY APPARATUS OF LIGHT BLOCKING TYPE

The present invention relates to an electric light display apparatus of the light blocking type.

Electric light display apparatus are known which comprise a multiplicity of dots arranged in the form of a matrix to provide a display portion and selectively controllable for lighting up to display the desired figure, illustration or like image. Apparatus employing incandescent lamps are well known as such. FIG. 1 shows an example of apparatus of this type, in which an incandescent lamp provides each dot and is turned on as controlled electrically to display an image. Although the apparatus of this type has the advantage that the image has a high luminance and is distinctly perceivable visually, the apparatus has the drawback of requiring high power consumption and necessitating a large number of drive circuits for turning on and off the lamps individually. Furthermore there is the need to provide in the rear of the display portion an arrangement for installing the lamps, a wiring system therefor and a space for the maintenance of the apparatus since the lamp is easy to burn out and must be replaced frequently, consequently giving a large depth to the apparatus. Additionally for reasons attributable to the installation and handling of the lamps or for the necessity of releasing the heat from the lamps, the lamps are arranged at a large spacing and are therefore unable to display continuous lines, so that when the display panel is viewed at a short distance therefrom, characters and illustrations appear with reduced sharpness. In the daytime, the image has a reduced contrast due to the reflection of external light from the surfaces of unlit lamps. Thus the apparatus has various drawbacks.

The main object of the invention is to overcome the above drawbacks of conventional apparatus and to provide an inexpensive and yet efficient electric light display apparatus.

The present invention will be described below with reference to the accompanying drawings, in which.

Figure 1:
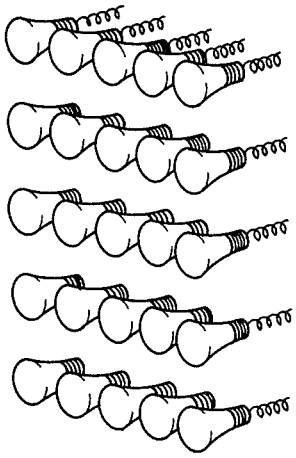
Fig.1 PRIOR ART
FIG. 1 is a perspective view schematically showing a conventional apparatus.
Figure 2:
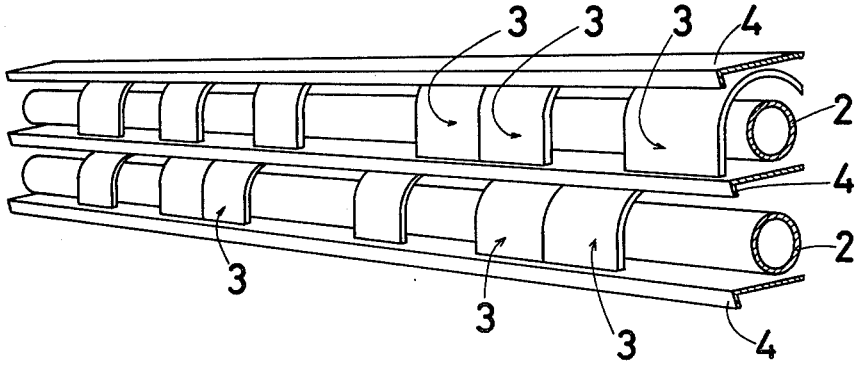
FIG. 2 is a perspective view of part of an embodiment of the invention to show the front side, i.e. display portion, thereof with a glass plate cover removed.
Figure 3:
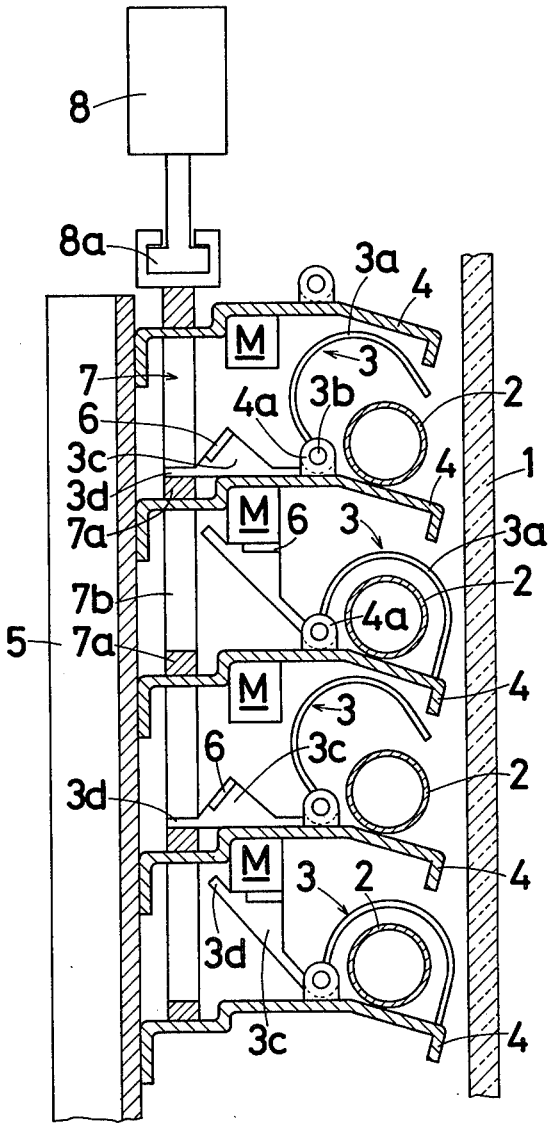
FIG. 3 is a view in vertical section of the embodiment.
Figure 4:
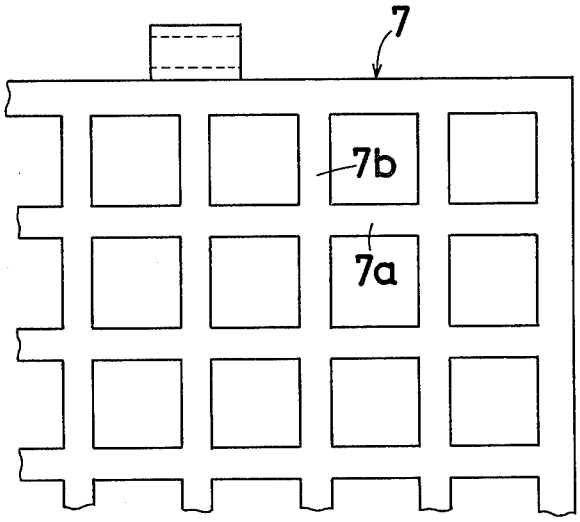
FIG. 4 is a front view showing a shifting member.
Figure 5:
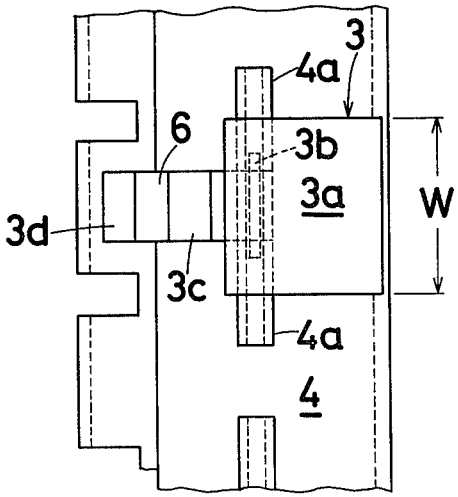
FIG. 5 is a plan view showing a light blocking member as attached to a support plate.
Figure 6:
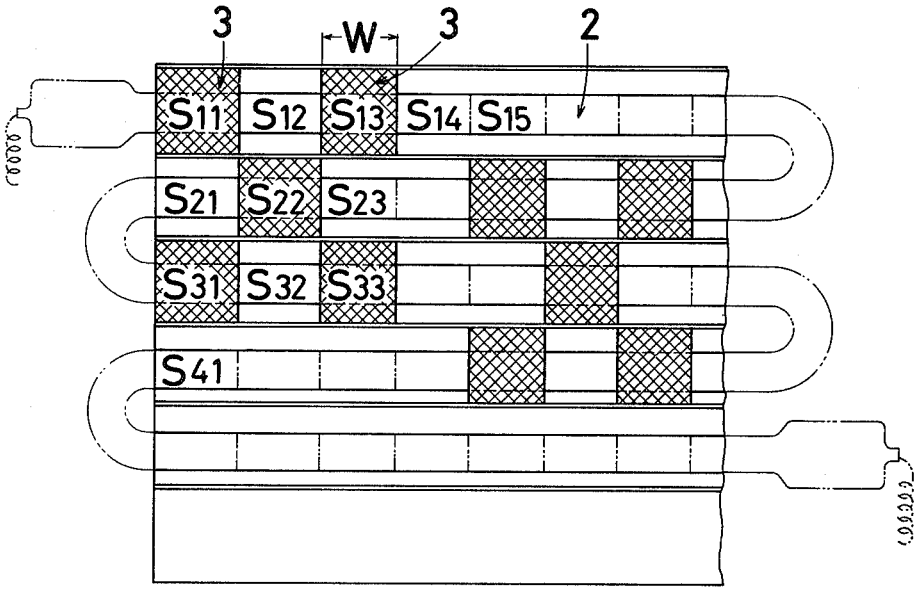
FIG. 6 is a front view showing the embodiment.
Figure 7:
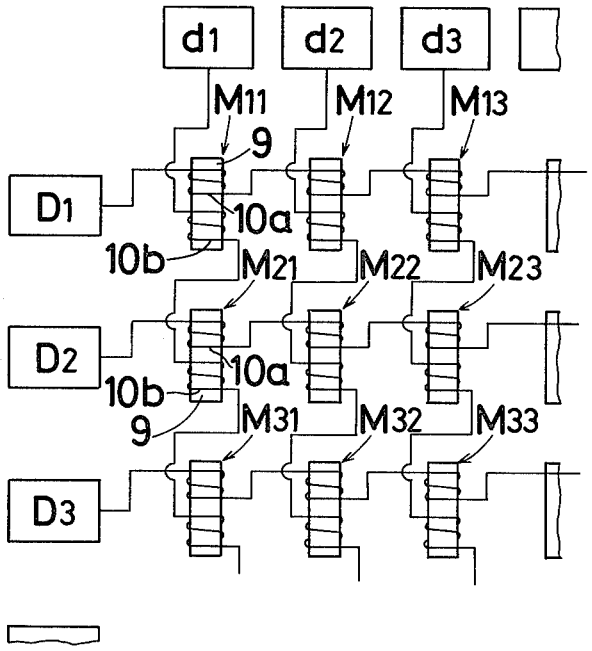
FIG. 7 is a diagram showing an arrangement of latch electromagnets.

With reference to FIGS. 2 to 9, a first embodiment will be described. Indicated at 1 is a glass plate which is provided on the front side of the apparatus. Discharge lamps, such as neon lamps or fluorescent lamps, are used as tubular light sources 2. The tubular light sources 2 are arranged horizontally immediately behind the front glass plate 1, i.e. in the foremost portion of the apparatus. Alternatively the light sources 2 may be arranged vertically. Each of the tubular light sources 2 is divided into a plurality of sections S arranged continuously longitudinally thereof (see FIG. 6). Each section S is provided with an openable or closable light blocking member 3. Support plates 4 for the light blocking members 3 extend horizontally and are attached to an upright mount plate 5 disposed in the rearmost portion of the apparatus. The light blocking member 3 comprises a circular arc shutter piece 3*a* having a predetermined width W, a pivot 3*b* and a tail portion 3*c*. The pivot 3*b* is supported by bearing portions 4*a* of the support plate 4 and positioned in the rear of the tubular light source 2 close thereto. The shutter piece 3*a* has the smallest possible radius of curvature to position the tubular light source 2 inside the circular arc thereof in proximity thereto when turned from behind to shield the section S. The tail portion 3*c* of the light blocking member 3 is heavier than the shutter piece 3*a*, so that in the position of the light blocking member 3 where the tail portion 3*c* is in contact with the upper surface of the support plate 4, i.e. in the light source exposing position, the light blocking member 3 assumes a stable position. The member 3 has a highly magnetic member 6 at its tail portion 3*c*. The member 6 is adapted to come into contact with a latch electromagnet M attached to the lower surface of the support plate 4 immediately above the member 3 when the member 3 is brought into the light source shielding position. In the shielding position, the center of gravity of the blocking member 3 is positioned in the rear of the pivot 3*b*, and the member 3 is unstable in this position and is urged counterclockwise in FIG. 3 toward the light source exposing position. When energized, the electromagnet M produces a magnetic field of relatively low intensity, such that only when the magnetic member 6 is in contact with the electromagnet M, the magnet M holds the member 6 attracted thereto to hold the light blocking member 3 in the light source shielding position. A shifting member 7 includes horizontal bars 7*a* and vertical bars 7*b* as seen in FIG. 3. The horizontal bars 7*a* are adapted to come into contact with the ends 3*d* of the tail portions 3*c* of all the light blocking members 3 from therebelow. Accordingly when the shifting member 7 is pulled up, the blocking members 3 are turned toward their shielding positions by this movement. A solenoid 8 has an operating member 8*a* which, when raised upon the energization of the solenoid 8, pulls up the shifting member 7 fitted to the member 8*a*. The shifting member 7 and the solenoid 8 serve as means for shifting the light blocking members 3 to their unstable positions, namely the light source shielding positions. As seen in FIG. 7, the latch electromagnets M are arranged in a chessboard pattern in corresponding relation to the light blocking members 3 for shielding or exposing the sections S of the tubular light sources 2. The latch electromagnets M11, M12, . . . , M21, M22 . . . , Mxy comprise iron cores 9, and line coils 10*a* and column coils 10*b* provided around the cores 9. The line coils 10*a* in each line are connected in series with a line drive circuit D1, D2, . . . , or Dx provided for the line. The column coils 10*b* in each column are connected in series to a column drive circuit d1, d2, . . . , or dy provided for the column. Each of the latch magnets M thus arranged and connected is adapted to latch the light blocking member 3 concerned in its shielding position even when current is passed through only one of the line coil lO*a* and the column coil 10*b* thereon. Only when current flows through neither of these coils 10*a* and 10*b*, i.e. when the magnet M is unenergized at all, the member 3 is free from being held to the shielding position. Thus when the member 3 is in the light source exposing position, the member 3 remains in this position irrespective of whether the magnet M is energized or unenergized, but after the member 3 has been shifted to the shielding position by the shifting means 7 and 8, the member 3 shifts to the exposing position under gravity only when the magnet M is completely de-energized.

Figure 8:
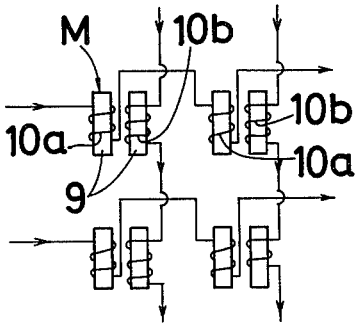
FIG. 8 is a diagram showing another arrangement of latch electromagnets.
Figure 9:
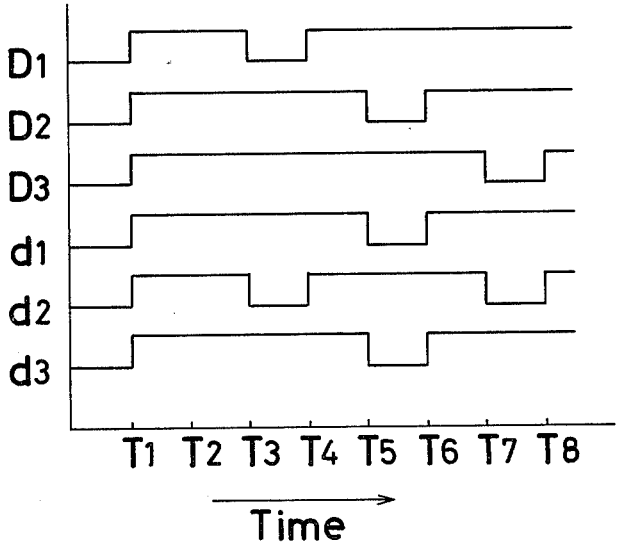
FIG. 9 is an operation timing chart for the embodiment.

The present embodiment will be operated in the following manner. For a better understanding, reference will be made to the nine sections S11, S12, S13, S21, S22, S23, S31, S32 and S33 at the upper left of the display portion shown in FIG. 6 to give a display wherein the sections S11, S13, S22, S31 and S33 are shielded, with the sections S12, S21, S23 and S32 exposed. With reference also to the timing chart of FIG. 9, at time T1, all the line drive circuits D1, D2, . . . and the column drive circuits d1, d2, . . . are energized to energize the latch electromagnets M11, M12, . . . , Mxy. Next at time T2, the solenoid is energized to pull up the shifting member 7 and thereby shift all the light blocking members 3 to the light source shielding positions, in which the members 3 are latched onto the magnets M. In this state, all the sections S are held shielded. Subsequently at time T3, the line drive circuit D1 for the first line and the column drive circuit d2 for the second column are turned off, thereby completely de-energizing the magnet M12 only in the first line, the second column, whereby the light blocking member 3 held attached to the magnet M12 is turned counterclockwise to expose the section S12 of the tubular light source 3. At time T4, the first line drive circuit D1 and the second column drive circuit d2 are turned on again. This re-energizes the magnet M12, but the member 3 leaves the section S12 exposed. At time T5, the second line drive circuit D2 and the first column and third column drive circuits d1, d3 are turned off, releasing the corresponding members 3 from the magnets M21, M23 to expose the sections S21, S23. At time T6, the second line drive circuit D2 and the first column, third column drive circuits d1, d3 are turned on again. At time T7, the third line drive circuit D3 and the second column drive circuit d2 are turned off to de-energize the magnet M32 and expose the corresponding section S32. Further at T8, the third line drive circuit D3 and the second column drive circuit d2 are turned on. The contemplated display is now completed with use of the nine sections mentioned. The other sections can be handled in the same manner as above. The above procedure is followed generally quickly to complete the display within a short period of time. The light blocking member 3 needs not always be opened first in the first line, then in the second line and so forth in the order mentioned, but the member 3 in the desired line or column is movable at any time. Accordingly any desired illustration can be displayed by performing the required steps in any order or at any time intervals. While FIG. 7 shows the latch electromagnets M of the type described, FIG. 8 shows latch electromagnets M of another type comprising a line coil 10*a* and a column coil 10*b* which are provided around separate iron cores 9 and 9 individually as a set.

The electric light display apparatus described can be constructed with a reduced thickness or depth. Because the apparatus comprises tubular light sources arranged in a plurality of rows on the front side of the apparatus and each divided into a plurality of unit sections arranged continuously longitudinally of the light source and each made shieldable by a light blocking member, the direct light from the light source is almost entirely emitted outward, and the light reflected from the light blocking member behind the light source or from the support plate, etc. also serves as a light source. Thus the tubular light source operates efficiently. Since the light source is divided into the unit sections each by the width of the blocking member itself, the dark portions between the unit sections are very small, consequently giving images of high luminance which are distinctly perceivable visually and appear continuously and naturally. Further since the light blocking members for each tubular light source are withdrawn rearward through the space between the light source and another light source immediately thereabove, the spacing between the light sources can be decreased greatly. This provides picture elements with a high density. The number of the drive circuits required is as small as the combined number of the lines and columns. This greatly simplifies the construction of the apparatus as compared with the conventional apparatus of the incandescent lamp type which necessitates a drive circuit for each display element. The tubular light source, for which a discharge tube or like low-power light source is usable, assures great savings in power and is less susceptible to troubles such as burning out. Since the light source is adapted to be shielded completely by light blocking members, a reduced contrast will not result from the reflection of external light which occurs when exposed incandescent lamps are used.

Figure 10:
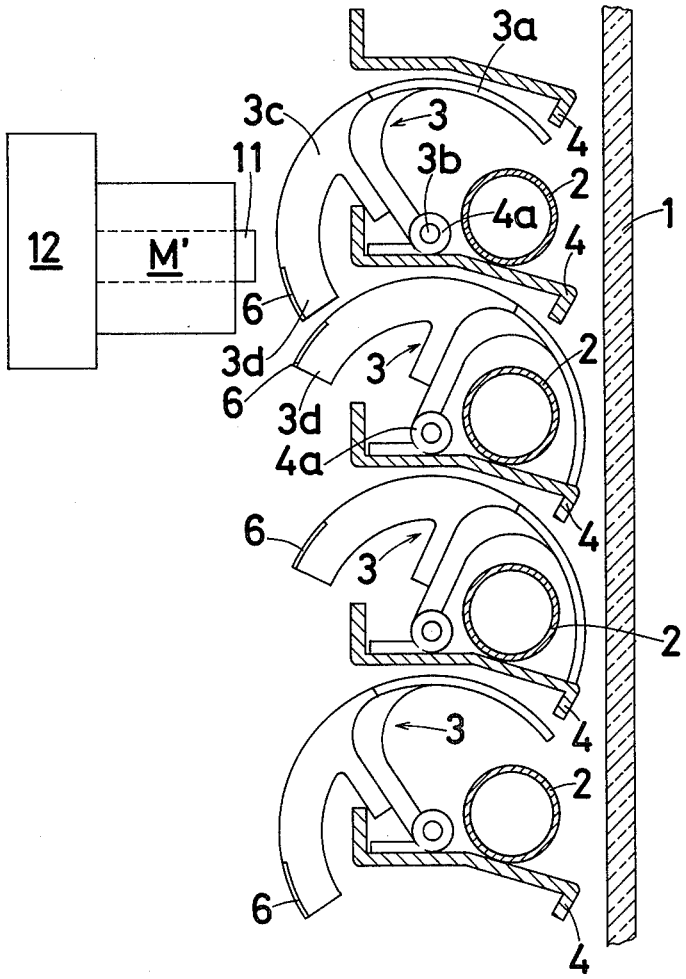
FIGS. 10 to 12 are sectional views showing other different embodiments.

Besides the means described above for driving the light blocking member in the foregoing embodiment, the blocking member can be made openable or closable only electromagnetically as already known. The systems for driving light blocking members only by the electromagnetic force include a direct drive system wherein an electromagnet is provided for each light blocking member, and an electromagnet carriage system wherein electromagnents corresponding in number to the number of the rows or columns of light blocking members are arranged vertically or horizontally on a movable carriage to drive the blocking members with the travel of the carriage. FIG. 10 shows another embodiment of the invention wherein a carriage 12 is used for driving light blocking members 3. This embodiment is substantially similar to the foregoing in respect of the shapes and arrangement of glass plate 1, tubular light source 2, light blocking members 3 and support plates 4, with the exception of the following. A shutter piece 3*a* is continuous with a tail portion 3*c* having a rearwardly projecting tail end 3*d*. The tail end 3*d* carries a highly magnetic member 6 which is positionable close to the attracting end 11 of an electromagnet M'. The light blocking member 3 supported by a pivot 3*b* is in balance under gravity, such that it is self-stabilized when in a light source exposing position and also when in a light source shielding position. The carriage 12 is movable behind the light blocking members 3. The electromagnets M' corresponding in number to the number of the columns of the light blocking members 3 are arranged horizontally on the carriage 12. Every time the carriage 12 moves upward or downward once, the electromagnets M' pass by all the members 3 once in the rear thereof. When an energized electromagnet M' passes immediately behind a particular member 3, the magnet attracts the magnetic member 6 on the member 3, thereby shifting the member 3 to the light source exposing position (if the carriage 12 moves down) or to the light source shielding position (if the carriage 12 moves up). Accordingly the desired image can be displayed by controlling the energization and de-energization of the magnets M' in timed relation with the upward and downward movement of the carriage 12. With the present embodiment, the light blocking member 3, once moved toward the shielding position or exposing position, is brought out of balance under gravity and shifted forward or rearward to either of the stable positions. The member 3 is not shiftable if the drive force on the member 3 is smaller than a limit, but when the force exceeds the limit even if slightly, the member 3 is shiftable reliably. Thus insofar as the attracting force between the magnet M' and the magnetic member 6 is set to a value greater than the limit, the member 3 is shiftable stably and reliably even if such a force varies slightly from magnet to magnet, without permitting any inadvertent shift due to vibration or some other extraneous force smaller than the limit.

Other embodiments are shown in FIGS. 11 to 14 which chiefly illustrate light blocking members without showing drive means. The drive means already described are usable for these embodiments.

Figure 11:
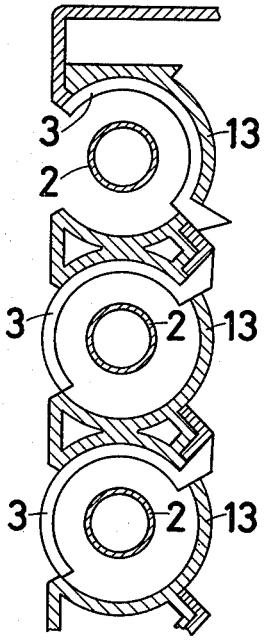

The embodiment of FIG. 11 includes a guide wall 13 provided behind a tubular light source 3 except on the front side thereof. A light blocking member 3 is slidable along the guide wall 13.

Figure 12:
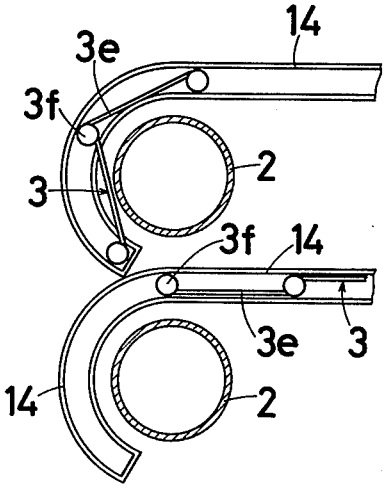

The embodiment of FIG. 12 comprises a foldable light blocking member 3 which is movable forward or backward along a guide 14. The guide 14, which is in the form of a strip, is disposed between each two light blocking members 3. The member 3 comprises planar portions 3*e* and a joint 3*f* at which the member 3 is foldable and guided. The member 3 may alternatively be made of a flexible material so as to be movable along the guide 14.

Figure 13:
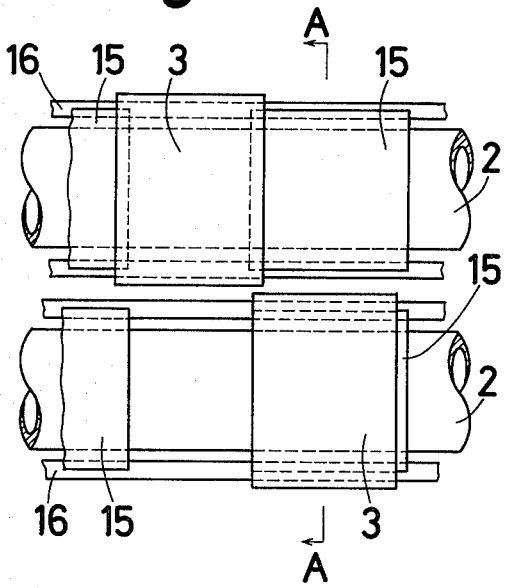
FIG. 13 is a front view showing another embodiment.
Figure 14:
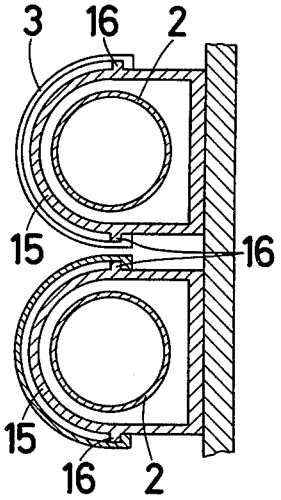
FIG. 14 is a view in section taken along the line A—A in FIG. 13.

Although the foregoing embodiments are so adapted that the sections S of the tubular light source 2 arranged continuously longitudinally thereof are partitioned each by the width of the light blocking member 3, FIGS. 13 and 14 show another different embodiment. A tubular light source 2 is divided into sections S which are continuous longitudinally thereof and about one half of each of which serves as a portion 15 to which a light blocking member 3 is retracted. The retraction portion 15 covers over the entire width thereof the tubular light source 2 and forms a dark portion. The light blocking member 3 is circular arc, covers the front side of the light source 2 and is slidable on slide rails 16 disposed above and below the light source 2 longitudinally thereof. The member 3 is positioned over the retraction portion when exposing the light source 2 but covers the portion between the adjacent retraction portions 15 when shielding the light source. Although each section S has a dark portion even when the member 3 is in the exposing position, no problem will arise when the section S is made small.

Any light source is usable for the foregoing embodiments provided that it is slender. The cross sectional shape and the light emitting method are not particularly limited. Instead of using the separate tubular light sources 2, a single light source is usable in a bent form as indicated in phantom lines in FIG. 6 to achieve the same result.

In addition to the advantages already described, the present apparatus exhibits a high luminance even if it is seen square, e.g. in an oblique direction. The guides provided for the light blocking members prevent them from deformation and assure smooth sliding movement.

The arrangement for shifting the light blocking members can be simplified when the member is made spontaneously shiftable from one of the light source exposing position and the shielding position to the other position and when a particular light blocking member is rendered shiftable to the shielding or exposing position by temporarily shifting all the blocking members to an unstable position first to hold them in the unstable position and thereafter freeing that blocking member. With use of separate means for shifting the blocking member to the unstable position and for holding the member in this position, the latch electromagnet consumes only a very small amount of power for holding the blocking member in position, hence great savings in energy. The latch electromagnet provided for each of the light blocking members comprises a plurality of independent coils, and the corresponding coils of the magnets are connected together in series independently of the other coils, such that the magnet frees the corresponding light blocking member only when no current flows through either of the coils thereof. Because of this arrangement, all the latch electromagnets are controllable by a small number of drive circuits. This simplifies the drive assembly.

What is claimed is:

1. An electric light display apparatus of the blocking type comprising a transparent front plate, tubular light sources arranged in a plurality of rows in parallel immediately behind said front plate, each source divided into a plurality of unit sections arranged continuously longitudinally thereof, and a light blocking member provided for each of the unit sections and operable by electromagnetic means and mechanical means for shielding and exposing the unit section.

2. An electric light display apparatus as defined in claim 1 wherein the tubular light source is one of discharge lamps including a neon lamp and a fluorescent lamp.

3. An electric light display apparatus as defined in claim 1 or 2 wherein the light blocking members provided for each of the tubular light sources are arranged longitudinally of the light source to divide the light source into the unit sections each by the width of the blocking member itself.

4. An electric light display apparatus as defined in claim 1 wherein the light blocking member provided for a tubular light source is withdrawn rearward through the space between the light source and another tubular light source adjacent thereto.

5. An electric light display apparatus as defined in claim 4 wherein the light blocking member is circular arc and is pivotally movable from behind the tubular light source along a circular arc path to position the light source inside the arc when shielding the light source.

6. An electric light display apparatus as defined in claim 5 wherein the light blocking member is slidable along a guide wall provided behind the tubular light source.

7. An electric light display apparatus as defined in claim 4 wherein the light blocking member is foldable and movable forward and backward along a guide.

8. An electric light display apparatus as defined in claim 5 wherein the light blocking member is self-stabilized when in a light source exposing position and in a light source shielding position.

9. An electric light display apparatus as defined in claim 5 wherein each of the light blocking members is stable when in one of a light source exposing position and a light source shielding position and is unsable when in the other position, the light blocking member being urged at all times to shift toward the stable position, the light blocking members being shiftable to the light source shielding or exposing position by temporarily shifting all the blocking members to the unstable position to hold the blocking members therein and selectively releasing the blocking members from the hold.

10. An electric light display apparatus as defined in claim 9 wherein the light blocking members are held in the unstable position individually by latch electromagnets provided in corresponding relation to the blocking members, and each of the electromagnets comprises a plurality of independent coils, the corresponding coils of the electromagnets being connected together in series independently of the other coils, the light blocking member being releasable from the unstable postion by the corresponding electromagnet only when no current flows through the independent coils thereof.

11. An electric light display apparatus as defined in claim 1 or 2 wherein the light blocking member is slidable within the unit section longitudinally of the tubular light source, shields the tubular light source over the width of the member and retracts to a refraction portion always forming a dark portion over part of the unit section when exposing the unit section.

* * * * *